US009021975B1

(12) United States Patent
Fodor et al.

(10) Patent No.: US 9,021,975 B1
(45) Date of Patent: May 5, 2015

(54) CONVERTIBLE MARINE LOUNGER SEAT

(71) Applicants: Carrie A. Fodor, Cape Canaveral, FL (US); John W. Hamilton, Mims, FL (US); Erin L. Schwarz, Rockledge, FL (US); Frank Morgan, Melbourne, FL (US)

(72) Inventors: Carrie A. Fodor, Cape Canaveral, FL (US); John W. Hamilton, Mims, FL (US); Erin L. Schwarz, Rockledge, FL (US); Frank Morgan, Melbourne, FL (US)

(73) Assignee: Brunswick Corporation, Lake Forest, IL (US)

( * ) Notice: Subject to any disclaimer, the term of this patent is extended or adjusted under 35 U.S.C. 154(b) by 33 days.

(21) Appl. No.: 14/032,430

(22) Filed: Sep. 20, 2013

(51) Int. Cl.
*B63B 29/04* (2006.01)

(52) U.S. Cl.
CPC ..... *B63B 29/04* (2013.01)

(58) Field of Classification Search
CPC ..... B63B 29/00; B63B 29/04; A47C 17/00; A47C 17/16
USPC ..... 114/363
See application file for complete search history.

(56) References Cited

U.S. PATENT DOCUMENTS

| | | | | |
|---|---|---|---|---|
| 461,198 | A | 10/1891 | Henry | |
| 489,562 | A | 1/1893 | Johnston | |
| 2,466,204 | A | 4/1949 | Brown | |
| 2,610,329 | A | 9/1952 | Strathaus | |
| 2,679,653 | A | 6/1954 | Blanke et al. | |
| 2,971,568 | A | 2/1961 | Rorie et al. | |
| 3,099,482 | A | 7/1963 | Woodruff | |
| 3,379,471 | A | 4/1968 | Dalziel | |
| 3,394,417 | A * | 7/1968 | O'Link | 114/363 |
| 3,884,522 | A * | 5/1975 | Arima et al. | 114/363 |
| 4,637,081 | A * | 1/1987 | Clark | 114/363 |
| 4,854,261 | A * | 8/1989 | Goldsmith | 114/363 |
| 5,517,706 | A | 5/1996 | Kashima et al. | |
| 5,718,479 | A | 2/1998 | Rautenbach | |
| 5,799,605 | A | 9/1998 | Huse | |
| 5,902,009 | A | 5/1999 | Singh et al. | |
| 6,199,945 | B1 | 3/2001 | Kim | |
| 6,283,059 | B1 | 9/2001 | Scully, Jr. | |
| 6,488,333 | B2 | 12/2002 | Kim | |
| 6,494,531 | B1 | 12/2002 | Kim | |
| 6,880,482 | B2 * | 4/2005 | Huse | 114/363 |
| 6,883,458 | B2 | 4/2005 | Huse | |
| 6,945,190 | B1 | 9/2005 | Frandsen | |
| 6,988,774 | B1 | 1/2006 | Elzenbeck | |
| 7,172,252 | B2 | 2/2007 | Henning | |
| 7,237,845 | B2 | 7/2007 | Mulmed | |
| 7,281,761 | B2 | 10/2007 | Brown et al. | |
| 7,341,306 | B1 | 3/2008 | Neese et al. | |
| 7,484,795 | B2 | 2/2009 | Saint-Jalmes et al. | |
| 7,523,989 | B2 | 4/2009 | Wieland et al. | |
| 7,661,382 | B2 | 2/2010 | Wood et al. | |
| 2006/0076819 | A1 | 4/2006 | Burch | |
| 2007/0158986 | A1 | 7/2007 | Adams et al. | |
| 2009/0146477 | A1 | 6/2009 | Yamada et al. | |

* cited by examiner

*Primary Examiner* — Lars A Olson
(74) *Attorney, Agent, or Firm* — Malin Haley DiMaggio & Bowen, P.A.

(57) ABSTRACT

A seating system for marine vessels and watercraft including a chair having a backrest and a seat bottom and a lounge extension element wherein a first end of the extension element is hingeably attached to and extends from the seat bottom and wherein a second end of the extension element is configured to be hingeably attached to a first rigid structure such as a bulkhead on a watercraft. The seating system is convertible between a forward-facing seat configuration and an aft-facing lounger configuration. In the aft-facing lounger configuration, the extension element and the seat bottom are substantially parallel to one another. In the forward-facing seat configuration, the extension element is substantially upright and at an acute angle with respect to said seat bottom.

3 Claims, 3 Drawing Sheets

CONVERTIBLE MARINE LOUNGER SEAT

CROSS REFERENCE TO RELATED APPLICATIONS

N/A

STATEMENT REGARDING FEDERALLY SPONSORED RESEARCH OR DEVELOPMENT

N/A

BACKGROUND OF THE INVENTION

1. Field of the Invention

The present invention generally relates to marine vessels and watercraft and more particularly to a convertible lounger seat for marine vessels and watercraft.

2. Description of Related Art

Marine vessel and watercraft designs have included a variety of seating arrangements and designs for the boaters. Specifically, there are many different designs for seats located within a boat, especially for open topped boats commonly used for day trips of limited duration for recreational or sport fishing purposes. Many seats provide the user with a variety of positions in which to sit such as forward-facing, aft-facing, lounging, etc. However, due to the limited space within a boat, these different positions must be operable within small parameters, necessitating thoughtful and ergonomic design.

Typically, modern boats have seats which are rigidly fixed and can only change from providing an upright position to providing a reclining position, but the user's legs are left without support. Other designs provide the ability to recline, but with cumbersome parts and uncomfortable ergonomics. Further, users of boats often desire to stretch out or relax in comfort but because of the limited space provided on the seat of a boat, this is either impossible or uncomfortable.

Although prior designs have sought to improve the structure, operation, and utility of seats on marine vehicles, these designs have failed to adequately maximize space and allow for a variety of seated, lounging, and sunbathing positions. For example, U.S. Pat. No. 5,799,605 issued to Huse discloses an expandable boat seat that utilizes a slidable base in order to expand and contract the available seating surface. U.S. Patent Application Publication No. 2007/0158986 to Adams et al. discloses an adjustable sun lounge which converts from a seating configuration to a sunbathing configuration and sun lounge by way of a pivoting, dual-sided backrest. U.S. Pat. No. 7,241,306 to Neese et al. describes a convertible seat assembly which includes two seats in back to back relationship whereby the base of one seat can be extended out to form a lounge seat on one side with a standard seat on the other, sharing a single back rest. While these designs provide some modularity as to seating positions, they require complex, heavier mechanisms that require a large amount of free space and are substantially limited as to the number of possible seating positions. Accordingly, there is a need in the art for a better designed, more modular seating system for marine vessels that provides optimum comfort and a variety of usable seating and lounging positions while maintaining simple operation and a unified appearance.

It is, therefore, to the effective resolution of the aforementioned problems and shortcomings of the prior art that the present invention is directed. However, in view of the marine vessel seating systems in existence at the time of the present invention, it was not obvious to those persons of ordinary skill in the pertinent art as to how the identified needs could be fulfilled in an advantageous manner.

SUMMARY OF THE INVENTION

The present invention provides various embodiments of a seating system designed for use on marine vessels and watercraft. In some embodiments, the seating system comprises a chair having a backrest and a seat bottom and a lounge extension element wherein a first end of the extension element is hingeably attached to and extends from the seat bottom and wherein a second end of the extension element is configured to be hingeably attached to a first rigid structure such as a bulkhead on a watercraft.

The seating system is convertible between a forward-facing seat configuration and an aft-facing lounger configuration. In the aft-facing lounger configuration, the extension element and the seat bottom are substantially parallel to one another. In the forward-facing seat configuration, the extension element is substantially upright and at an acute angle with respect to said seat bottom. In the forward-facing seat configuration, the roles of the seat bottom and backrest of the chair are reversed; in other words, the chair portion pivots and rotates approximately ninety degrees as the extension element pivots upward about its hinged connection with the seat bottom. When the system is in said aft-facing lounger configuration, the backrest is configured to rest against a second rigid structure such as a console or other bulkhead on the watercraft.

In some embodiments, a support bracket is attached to the bottom of the chair, wherein the bracket is attached to both the seat bottom and the backrest. Further, in some embodiments, or more stops extend from the bottom of the seat bottom and are configured to be disposed against the bottom of the extension element when the seating system is in the forward-facing seat configuration.

Accordingly, it is an object of the present invention to provide a convertible lounger seat that is operable between a first forward-facing helm seat configuration and a second aft-fact lounger seat.

It is another object of the present invention to accomplish the convertible seating configurations with a simple design and limited hinge points.

It is another object of the present invention to provide a simple to operate and sturdy convertible lounger for use on watercraft.

In accordance with these and other objects which will become apparent hereinafter, the instant invention will now be described with particular reference to the accompanying drawings.

DETAILED DESCRIPTION

Figure 1:
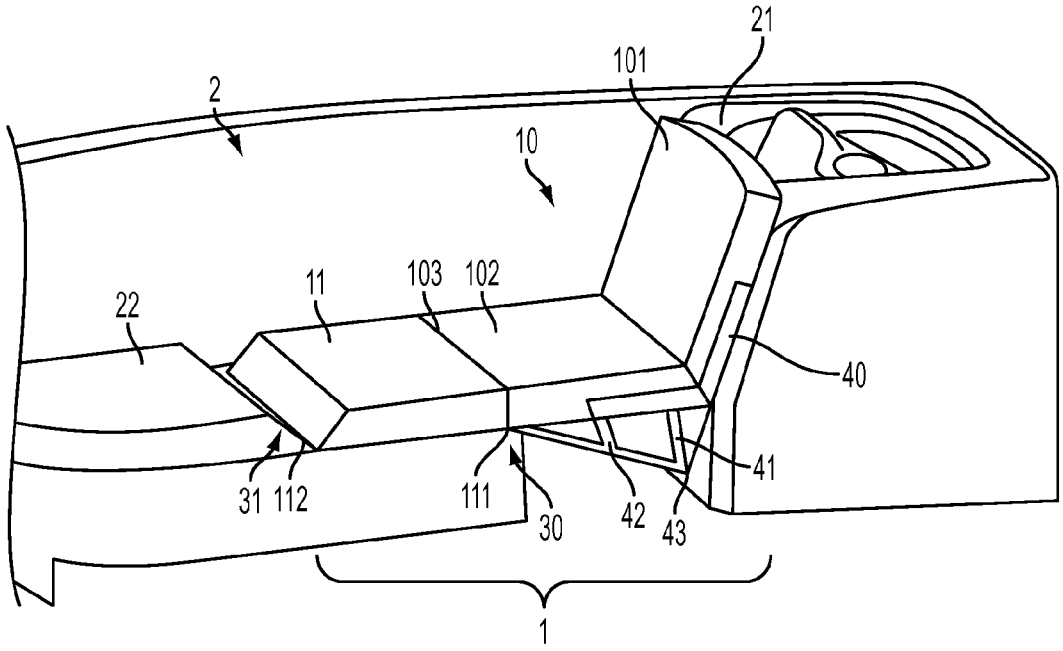
FIG. 1 is a perspective view of one embodiment of the seating system of the present invention in an aft-facing lounger configuration.

With reference to FIG. 1, shown is a perspective view of the convertible seat 1 of the present invention installed in a watercraft 2. In this configuration, seating system 1 is provided as an aft-facing lounger that is convertible into a port-side helm seat. The location and orientation of seating system 1, however, is not limited to the embodiments shown and described herein. Convertible seating system 1 comprises a chair 10 and a lounge extension element 11. Chair 10 includes a backrest 101 and a seat bottom 102 wherein the backrest 101 and bottom 102 are rigidly connected to each other. The chair 10 rests against console 21 of watercraft 2. The first end 111 of lounge extension element 11 is hingeably attached to the leading edge 103 of seat bottom 102, defining a first hinge point 30. The second end 112 of lounge extension element 11 is hingeably attached to the bulkhead 22 of watercraft 2, defining a second hinge point 31. In other words, the lounge extension element 11 is disposed between the seat bottom 102 and bulkhead 22. It is appreciated that the bulkhead should not be construed as limiting as the present invention can utilize any suitably rigid structure on which to attach the second end 112 of the extension element 11 and still retain the functionality described herein. Likewise, the chair 10 need not necessary rest against a console as shown but again can rest against any suitable rigid structure provided it can still retainer the functionality described herein. In the aft-facing lounger configuration shown in FIG. 1, the extension element 11 is substantially flat and parallel with the seat bottom 102 so as to provide an elongated lounger seat extending rearward from the seatback 101.

Figure 2:
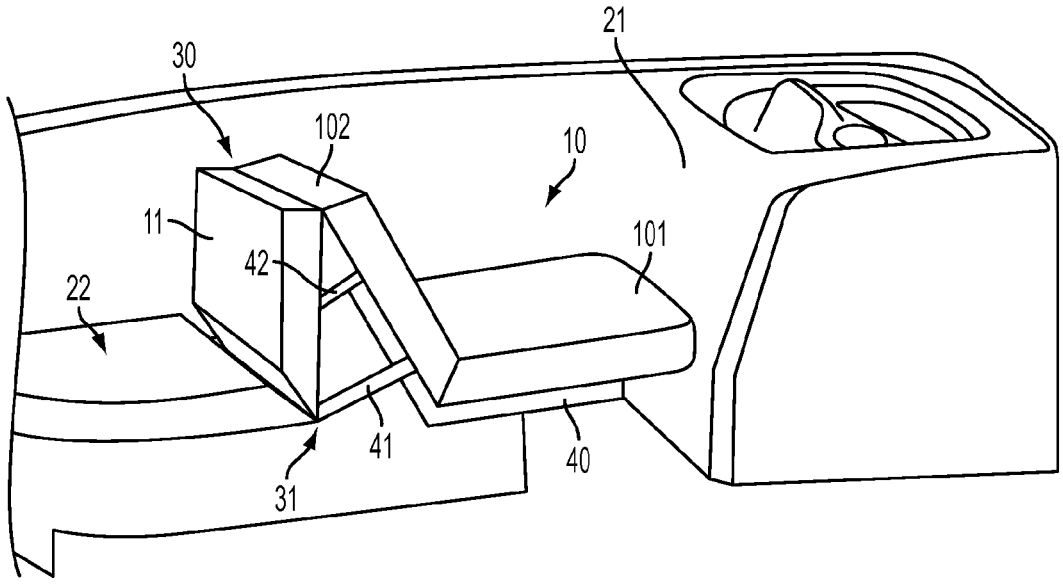
FIG. 2 is a perspective view of one embodiment of the seating system of the present invention in a forward-facing helm seat configuration.

With reference to FIG. 2, shown is the convertible seating system 1 converted into a forward-facing helm seat. To convert the system 1 to this configuration, the seating system 1 is collapsed upward about hinge point 30 which causes extension element 11 to pivot upward about pivot point 31 while chair 10 begins to pivot downward. Here, chair 10 releases from resting against console 21 and, in some embodiments, rotates approximately ninety (90) degree such that the roles of the seat bottom 102 and backrest 101 are reversed, i.e. the seat bottom 102 functions as a backrest and the backrest 101 functions as a seat bottom. As such, the extension element 11 is also configured to pivot approximately ninety (90) degrees such that it is substantially upright when the system 1 is in its helm seat configuration. In this configuration, the extension element 11 is substantially perpendicular to the backrest 101, wherein the backrest 101 is actually functioning as the seat bottom and the extension element 11 is at an acute angle with respect to the seat bottom 102.

Figure 3:
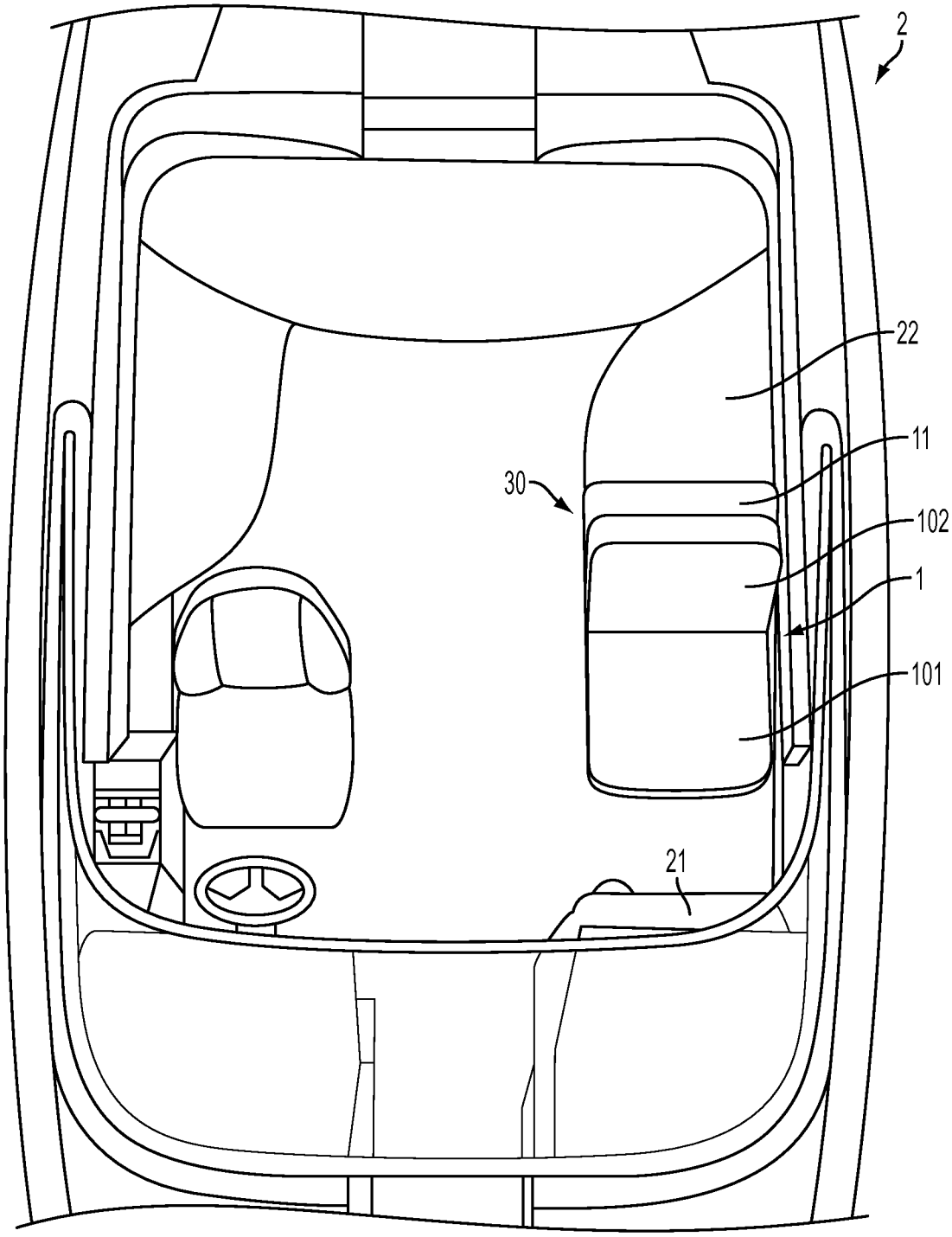
FIG. 3 is a top view of one embodiment of the seating system of the present invention in a forward-facing helm seat configuration.
Figure 4:
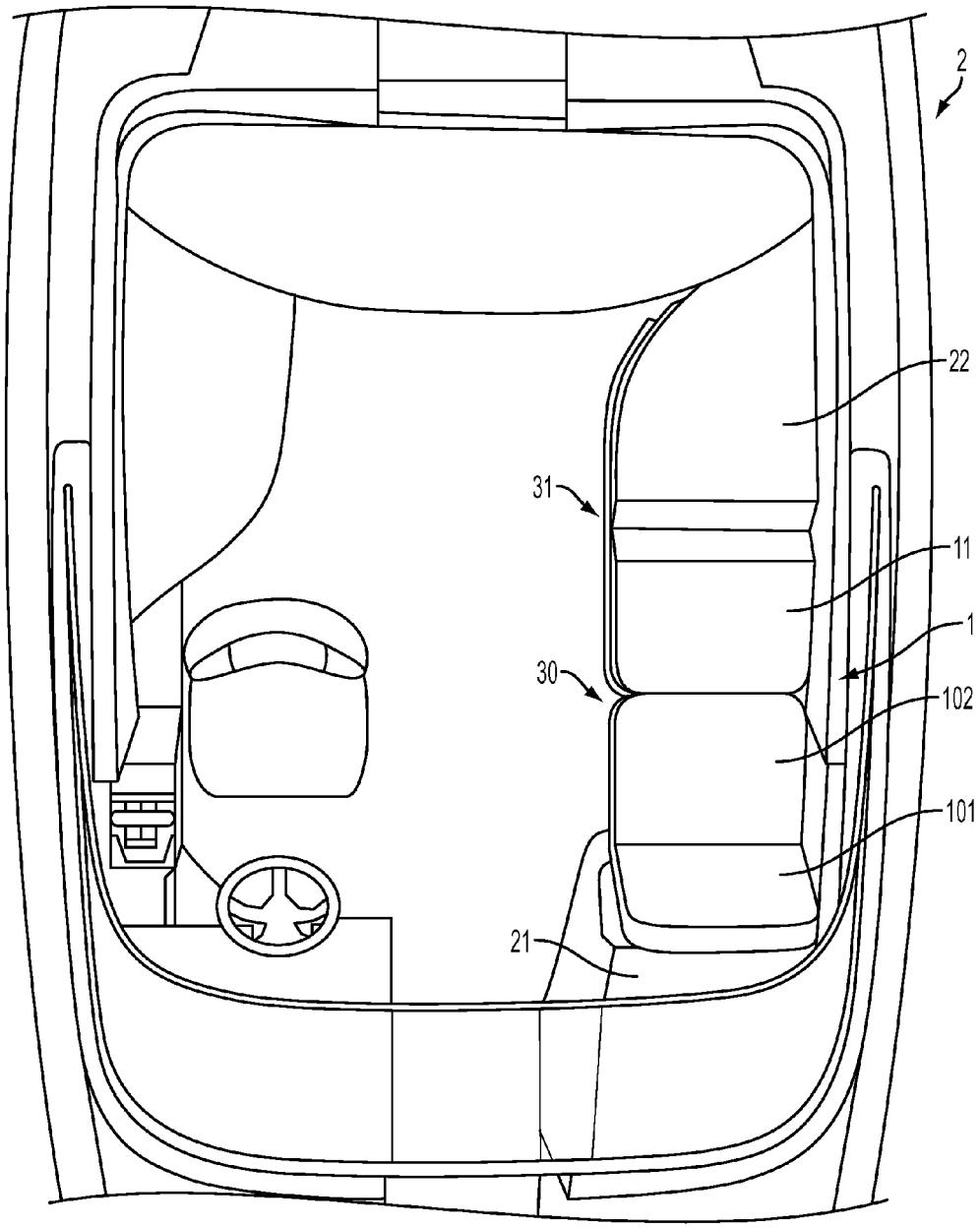
FIG. 4 is a top view of one embodiment of the seating system of the present invention in an aft-facing lounger configuration.

Of course, the conversion process can be reversed in order to turn the helm seat configuration into an aft-facing lounger by pulling the chair 10 upward and outwards causing the extension element 11 to pivot about hinge point 31 and further causing the extension element 11 and seat bottom 102 to pull apart from each other about hinge point 30. Chair 10 is brought to rest with backrest 101 resting against console 21 or other similar situated rigid structure, thus resulting in the aft-facing lounger shown in FIG. 1. FIGS. 3-4 provide top views of the seating system 1 in the helm seat (FIG. 3) and aft-facing lounger (FIG. 4) configurations.

In some embodiments, to provide structural rigidity and control the range of motion of the seating system 1, the chair 10 includes substructure. In some embodiments, an angled support bracket 40 is attached beneath chair 10 matching the profile of the underside of chair 10. In some embodiments, the support bracket is attached to the bottom surface or underside of both the backrest 101 and the seat bottom 102. This provides structural support and keeps the backrest 101 and seat bottom 102 rigidly attached to one other and helps to support the weight of a user sitting or lounging on the seating system 1. Further, in some embodiments, one or more stops 41 and 42 are provided which comprise support members extending from the bottom surface of seat bottom 102. The stops 41 and 42 are configured to act as stops between the underside of the seat bottom 102 and the extension element 11, when the seating system is collapsed into the helm seat configuration shown in FIGS. 2 & 3. In some embodiments, a cross-member 43 is attached across the distal ends of the stops 41 and 42 to provide additional support, particularly when a user is sitting in the helm seat configuration and body weight is applied against seat bottom 102 toward extension element 11. The cross-member 43 also functions as a safety by protecting the user from the ends of the stops 41 and 42. The length and dimensions of the stops 41 and 42 can vary depending on the desired range of motion and overall dimensions of the system 1. For example, in the depicted embodiment, the stops 41 and 42 are configured such that they will contact the bottom surface of the extension element 11 when the extension element 11 is perpendicular to the backrest 101 in the helm seat configuration.

It is appreciated that the present seating system 1 can comprise a variety of materials commonly used in construction of marine vessels and water craft including fiberglass, resins, plastics, vinyls, foams, and combinations thereof. Furthermore it is appreciated that the seating system 1 can be installed in any desired location on a marine vessel or watercraft including on the deck, in the cockpit, at the front of the vessel or elsewhere. In some embodiments, however, it is desirable to install the seating system 1 between two rigid structures such as the depicted bulkhead and console in order to provide adequate support for the two seating configurations described herein. It is appreciated that the seating system of the present invention is not limited for use in connection with marine vessels and watercraft although the system is particularly well suited for such applications. Finally, it is understood that the size, shape and overall dimensions of the seating system 1 is not limited to those dimensions inferred from the drawings herein. The invention is designed to be scalable for a variety of applications without departing from the novel structure and function described herein.

The instant invention has been shown and described herein in what is considered to be the most practical and preferred embodiments. It is recognized, however, that departures may be made therefrom within the scope of the invention and that obvious modifications will occur to a person skilled in the art.

What is claimed is:

1. A seating system comprising:

a chair having a backrest and a seat bottom;

a lounge extension element wherein a first end of said extension element is hingeably attached to and extends from said seat bottom and wherein a second end of said extension element is configured to be hingeably attached to a first rigid structure;

a support bracket directly attached to both said seat bottom and said backrest;

wherein said seating system is convertible between a forward-facing seat configuration and an aft-facing lounger configuration wherein in said aft-facing lounger configuration, said extension element and said seat bottom are substantially parallel to one another; and wherein in said forward-facing seat configuration, said extension element is substantially upright and at an acute angle with respect to said seat bottom.

2. A seating system comprising:

a chair having a backrest and a seat bottom;

a lounge extension element wherein a first end of said extension element is hingeably attached to and extends from said seat bottom and wherein a second end of said extension element is configured to be hingeably attached to a first rigid structure;

wherein said seating system is convertible between a forward-facing seat configuration and an aft-facing lounger configuration wherein in said aft-facing lounger configuration, said extension element and said seat bottom are substantially parallel to one another; and wherein in said forward-facing seat configuration, said extension element is substantially upright and at an acute angle with respect to said seat bottom;

wherein one or more stops extend from the bottom of said seat bottom and are configured to be disposed against the bottom of said extension element when said seating system is in said forward-facing seat configuration.

3. A seating system comprising:

a chair having a backrest and a seat bottom;

a lounge extension element wherein a first end of said extension element is hingeably attached to and extends from said seat bottom and wherein a second end of said extension element is configured to be hingeably attached to a first rigid structure;

wherein said seating system is convertible between a forward-facing seat configuration and an aft-facing lounger configuration wherein in said aft-facing lounger configuration, said extension element and said seat bottom are substantially parallel to one another; and wherein in said forward-facing seat configuration, said extension element is substantially upright and at an acute angle with respect to said seat bottom;

wherein when said system is in said aft-facing lounger configuration, said backrest is configured to rest against a second rigid structure.

* * * * *